US010316860B2

(12) United States Patent
Fujimoto et al.

(10) Patent No.: US 10,316,860 B2
(45) Date of Patent: Jun. 11, 2019

(54) CENTRIFUGAL FAN HAVING IMPELLER WITH BLADES BETWEEN ANNULAR SHROUD AND MAIN PLATE

(71) Applicant: MINEBEA CO., LTD., Kitasaku-Gun, Nagano (JP)

(72) Inventors: Seiya Fujimoto, Fukuroi (JP); Kiyohisa Nara, Fukuroi (JP); Tetsuya Seki, Fukuroi (JP)

(73) Assignee: Minebea Co., Ltd., Nagano (JP)

( * ) Notice: Subject to any disclaimer, the term of this patent is extended or adjusted under 35 U.S.C. 154(b) by 0 days.

(21) Appl. No.: 15/220,543

(22) Filed: Jul. 27, 2016

(65) Prior Publication Data

US 2017/0030378 A1 Feb. 2, 2017

(30) Foreign Application Priority Data

Jul. 31, 2015 (JP) ..... 2015-152587

(51) Int. Cl.

| | |
|---|---|
| ***F04D 25/06*** | (2006.01) |
| ***F04D 29/42*** | (2006.01) |
| ***F04D 29/16*** | (2006.01) |
| ***F04D 29/28*** | (2006.01) |

(52) U.S. Cl.

CPC ..... *F04D 29/4226* (2013.01); *F04D 25/0613* (2013.01); *F04D 29/162* (2013.01); *F04D 29/281* (2013.01); *F05D 2250/314* (2013.01)

(58) Field of Classification Search

CPC .... F04D 29/667; F04D 29/281; F04D 29/162; F04D 29/4226; F04D 13/06; F04D 13/0673; F04D 25/06; F04D 25/0613; F04D 25/064; F04D 29/28; F04D 29/40; F04D 29/403

USPC ..... 417/182

See application file for complete search history.

(56) References Cited

U.S. PATENT DOCUMENTS

| | | | | |
|---|---|---|---|---|
| 5,352,089 | A | 10/1994 | Tokunaga et al. | |
| 5,511,939 | A | 4/1996 | Tokunaga et al. | |
| 6,217,285 | B1 | 4/2001 | Kurokawa et al. | |
| 2008/0193305 | A1 | 8/2008 | Tateishi et al. | |
| 2013/0052049 | A1* | 2/2013 | Fujimoto | F04D 17/16 417/321 |

(Continued)

FOREIGN PATENT DOCUMENTS

| | | | |
|---|---|---|---|
| JP | S60-233398 | A | 11/1985 |
| JP | S63-109300 | A | 5/1988 |

(Continued)

*Primary Examiner* — Essama Omgba
*Assistant Examiner* — Stephen A Mick
(74) *Attorney, Agent, or Firm* — Carrier Blackman & Associates, P.C.; Joseph P. Carrier; Jeffrey T. Gedeon

(57) ABSTRACT

A centrifugal fan includes: a casing including an upper casing, a lower casing, and struts disposed between the upper casing and the lower casing; and an impeller that is provided in the casing, the impeller having an annular shroud, a plurality of blades, and a main plate, wherein the main plate of the impeller has an inclined surface between an inner circumference side and an outer circumference side of the impeller, and wherein the inner circumference side of the impeller is located at an upward position in an axial direction of the impeller, and the outer circumference side of the impeller is located at an downward position in the axial direction of the impeller.

5 Claims, 3 Drawing Sheets

(56) References Cited

U.S. PATENT DOCUMENTS

| | | | | |
|---|---|---|---|---|
| 2015/0118037 | A1 | 4/2015 | Otsuka et al. | |
| 2015/0176594 | A1* | 6/2015 | Gebert | F04D 29/282 416/186 R |
| 2016/0290358 | A1* | 10/2016 | Hayamitsu | F04D 17/16 |

FOREIGN PATENT DOCUMENTS

| | | | |
|---|---|---|---|
| JP | H05-296194 | A | 11/1993 |
| JP | H09-242699 | A | 9/1997 |
| JP | H10-054400 | A | 2/1998 |
| JP | 2006-132369 | A | 5/2006 |
| JP | 2007-154774 | A | 6/2007 |
| JP | 2012-207600 | A | 10/2012 |
| JP | 2015-086721 | A | 5/2015 |

* cited by examiner

CENTRIFUGAL FAN HAVING IMPELLER WITH BLADES BETWEEN ANNULAR SHROUD AND MAIN PLATE

BACKGROUND OF THE DISCLOSURE

1. Field of the Invention

The present invention relates to a centrifugal fan, and more particularly to a centrifugal fan which is reduced with a thickness and a noise.

2. Description of the Related Art

In the related art, as a fan widely used for cooling, ventilating, air conditioning of household electrical appliances, OA (Office Automation) equipment, and industrial equipment, air conditioning for vehicles, blowing, etc., a centrifugal fan has been known. As a related-art centrifugal fan, a centrifugal fan in which a casing is configured by an upper casing and a lower casing, an impeller is housed between the upper casing and the lower casing, and air suctioned from an inlet with rotation of the impeller is discharged from an outlet formed in a lateral surface between the upper casing and the lower casing toward the outside has been known (for example, see JP-A-2012-207600).

FIG. 5 illustrates a centrifugal fan 100 described in JP-A-2012-207600, where a quadrangular casing 120 is configured by an upper casing 121 and a lower casing 122, and an impeller 130 is housed between the upper casing 121 and the lower casing 122. The impeller 130 is provided with an annular shroud 131. The annular shroud 131 is configured to have a cylindrical part 132 in the center thereof and to be warped toward the upper casing 121 from the cylindrical part 132 to a periphery of the annular shroud 131, and is configured such that a shape of an upper surface from an end of the cylindrical part 132 of the annular shroud 131 to the periphery of the annular shroud 131 is formed in a shape of a curved surface in which four circular arcs having different radii of curvature are connected, and a cross-sectional area of an air flow passage up to the periphery of the annular shroud 131 is gradually increased. Thus, air is increased in pressure, and blows out from a periphery of the impeller 130 to the outside.

Air suctioned from an inlet 110 by high-speed rotation of the impeller 130 passes between the blades 135, blows out from the periphery of the impeller 130 to the outside, and is discharged from an outlet 111, which is formed in a lateral surface between the upper casing 121 and the lower casing 122. However, since the centrifugal fan 100 described in JP-A-2012-207600 has the shape in which the periphery of the annular shroud 131 is warped toward the upper casing 121, part of the air blowing out from the periphery of the impeller 130 may flow back from a gap 125 between the annular shroud 131 and the upper casing 121 toward the inlet 110, and a disturbance may occur at a flow of the air in the vicinity of the inlet 110 due to the air flowing backward, which is responsible for a noise.

When the full height the centrifugal fan is designated from restriction of a space mounted on the equipment or apparatus, the centrifugal fan 100 described in JP-A-2012-207600 may not meet a demand for reduction in thickness due to a height dimension of electronic components such as control IC, etc. mounted on a circuit board 140.

SUMMARY OF THE INVENTION

One of objects of the present invention is to provide a centrifugal fan in which an outlet is formed in a lateral surface of a quadrangular casing between an upper casing and a lower casing and which reduces a thickness and inhibits part of air blowing out from a periphery of an impeller from flowing backward to reduce a noise.

According to an illustrative embodiment of the present invention, there is provided a centrifugal fan including: a casing including an upper casing, a lower casing, and struts disposed between the upper casing and the lower casing; and an impeller that is provided in the casing, the impeller having an annular shroud, a plurality of blades, and a main plate, wherein the main plate of the impeller has an inclined surface between an inner circumference side and an outer circumference side of the impeller, and wherein the inner circumference side of the impeller is located at an upward position in an axial direction of the impeller, and the outer circumference side of the impeller is located at an downward position in the axial direction of the impeller.

DETAILED DESCRIPTION

Figure 1:
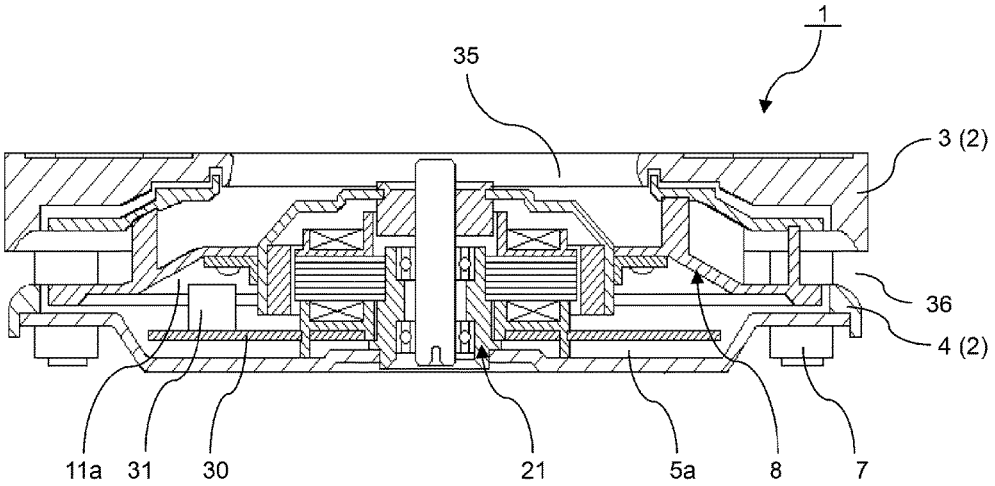
FIG. 1 is a cross-sectional view illustrating a centrifugal fan according to an embodiment of the invention.

Hereinafter, a mode for carrying out the invention (hereinafter referred to as "embodiment") will be described on the basis of the attached drawings. Throughout the description of the embodiment, the same reference numeral is given the same element.

Figure 2:
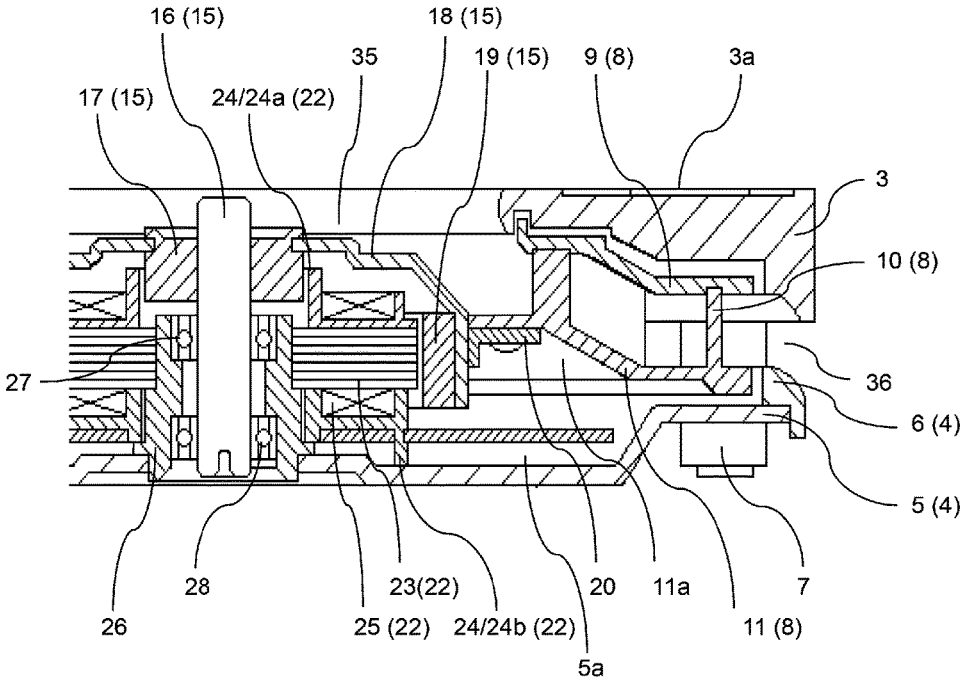
FIG. 2 is a partially enlarged view of the centrifugal fan illustrated in FIG. 1.

The basic structure of the centrifugal fan 1 is as follows. As illustrated in FIGS. 1 and 2, a casing 2 is configured by an upper casing 3 and a lower casing 4, and an impeller 8 is housed between the upper casing 3 and the lower casing 4. Air suctioned from an inlet 35 with the rotation of this impeller 8 passes between blades 10, and is discharged from an outlet 36, which is formed in a lateral surface from which struts 7 installed between the upper casing 3 and the lower casing 4 are removed, toward the outside of the casing 2.

A motor 21 is an outer rotor type brushless DC motor, and is mounted on a bottom of a recess part 5*a* formed in the motor base 5. A circuit board 30 mounted on a lower insulator 24*b* (to be described below) of the motor 21 is also housed in the recess part 5*a*. An electronic component 31 is mounted on the circuit board 30.

As illustrated in FIG. 2, bearings 27 and 28 are mounted on an inner side of a bearing holder part 26, and rotatably support a shaft 16. A stator 22 is set up on an outer side of the bearing holder part 26. The stator 22 is provided with a stator core 23 that is obtained by laminating a predetermined number of cores, an insulator 24 made up of an upper and lower insulators 24*a* and 24*b* that are mounted from opposite sides in an axial direction that is a direction of the shaft 16 of the motor 21, and a coil 25 that is wound around teeth of the stator core 23 via the insulator 24. The stator core 23 is configured by laminating cores having a plurality of teeth (see FIG. 3, six teeth are exemplified in FIG. 3) that extend outward from an annular yoke in a radial direction. Thus, the bearing holder part 26 is fitted into an opening formed in the center of the stator core 23, and the stator 22 is set up at the outer side of the bearing holder part 26.

A rotor 15 is configured by the shaft 16, a boss part 17 mounted on the shaft 16, a cup-shaped rotor yoke 18 mounted on the boss part 17, and an annular magnet 19 fixed at an inner side of the rotor yoke 18. The rotor yoke 18 is caulked to the boss part 17, and the circuit board 30 is mounted on the lower insulator 24*b*.

The impeller 8 is configured by an annular shroud 9, a plurality of blades 10, and a main plate 11. The blades 10 and the main plate 11 are formed by integrally molding a resin. The blades 10 are extended from the main plate 11 in the axial direction, have a shape curved and inclined in a direction opposite to a rotational direction, and become backward blades (a so-called turbo type) with respect to the rotational direction. All of the blades 10 have the same shape, and both of the blades 10 and the annular shroud 9 are coupled by ultrasonic welding.

The main plate 11 of the impeller 8 has an inclined surface 11*a* between an inner circumference side and an outer circumference side. That is, the inner circumference side of the impeller 8 is located at an axial upper side, and the outer circumference side of the impeller 8 is located on an axial lower side. As a result, the inclined surface 11*a* is formed between these inner and outer circumference sides.

The impeller 8 and the rotor 15 are coupled in the following procedure. That is, first, an annular flange 20 is welded to an outer circumferential surface of the rotor yoke 18 by, for instance, resistance welding. Next, pins (not shown) formed on a lower surface of an inner circumference side of the main plate 11 by integral molding are fitted into through-holes formed in the flange 20, and tips of the pins are crushed by heat, and are thermally caulked. Thereby, both are coupled, and the impeller 8 is mounted on the rotor 15.

Figure 3:
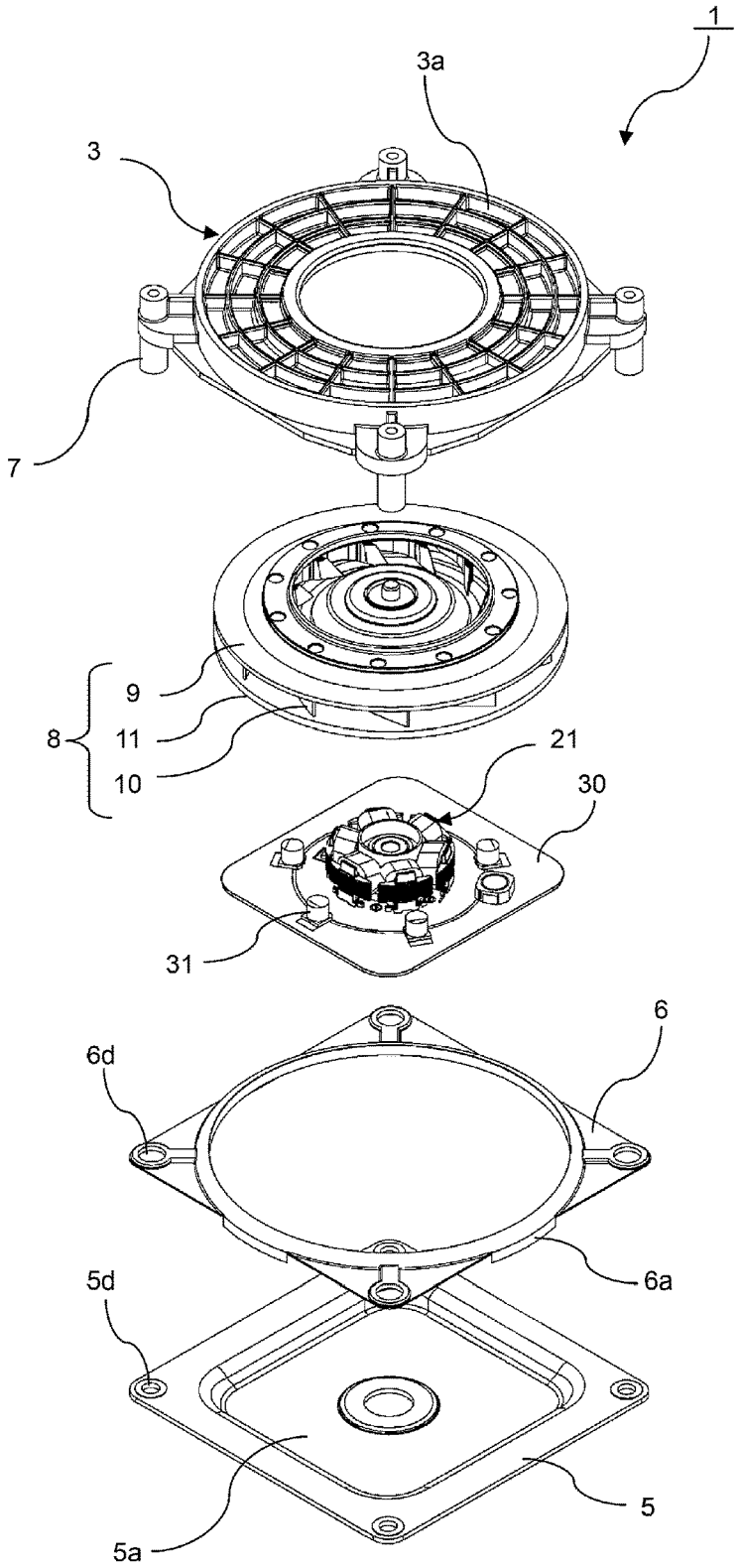
FIG. 3 is an exploded perspective view of the centrifugal fan illustrated in FIG. 1.

Coupling of each member will be described with reference to FIG. 3. A plurality of recess parts (thinned portions) 3*a* are formed at an upper surface side of the upper casing 3. The upper casing 3 and the lower casing 4 are coupled by installing the struts 7 between the upper casing 3 and the lower casing 4 and fastening the struts 7 with fasteners such as screws. To be specific, the struts 7 are formed by integral molding of a resin with the upper casing 3, and are fastened by tightening tapping screws to lower holes formed in the struts 7. The fastening means is not limited thereto. For example, a configuration in which screws (or bolts) are inserted into through-holes of the struts 7 from the lower casing 4 side and are fixed from the upper casing 3 side by nuts may be naturally adopted.

The lower casing 4 is configured by the motor base 5 made of a metal (for example, a steel sheet) and a base plate 6 made of a resin, and is formed by superimpose both. The motor 21 is mounted on the bottom of the recess part 5*a* formed in the motor base 5. Lateral portions 6*a* extending downward are formed at four places of an outer circumferential end of the base plate 6. Inner sides of these lateral portions 6*a* are in contact with outer circumferences of four sides of the motor base 5, and are positioned. Reference numerals 5*d* and 6*d* indicate through-holes.

In the present embodiment, as described above, the main plate 11 is provided with the inclined surface 11*a*. This is intended to reduce a thickness of the centrifugal fan 1. As illustrated in FIG. 1, components for controlling driving of the motor 21 and the electronic component 31 such as the control IC are mounted on the circuit board 30. For this reason, to prevent contact between the electronic component 31 mounted on the circuit board 30 and the impeller 8 in a limited space, the inclined surface 11*a* is formed at the main plate 11. Thereby, since a part of the electronic component 31 is housed at a position covered with this inclined surface 11*a*, the contact between the electronic component 31 and the impeller 8 can be prevented, and an axial reduction in thickness is achieved.

In the present embodiment, to reduce a noise, the upper casing 3 and the lower casing 4 is configured as follows. An upper end of the cylindrical part in which an opening serving as the inlet 35 of the annular shroud 9 is formed is located within an annular groove of the upper casing 3. Thereby, the upper casing 3 has a shape in which the upper end of the cylindrical part of the annular shroud 9 is covered. For this reason, even when air flows backward from an outer circumferential edge of the impeller 8, a backflow entering the inlet 35 can be suppressed by resistance at this place.

Figure 4:
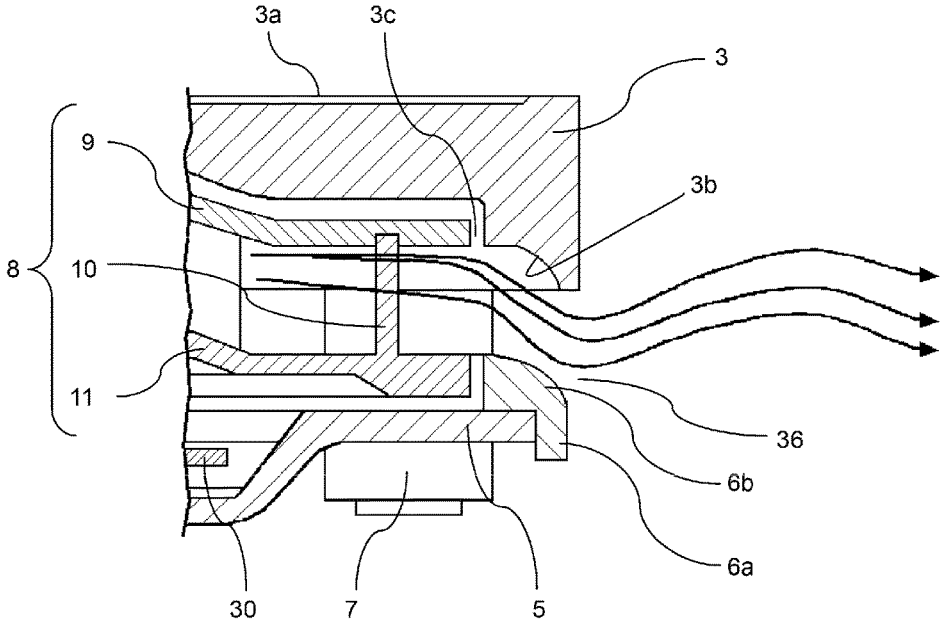
FIG. 4 is an explanatory view illustrating a flow of air blowing out from an outlet in the centrifugal fan according to the embodiment of the invention.
Figure 5:
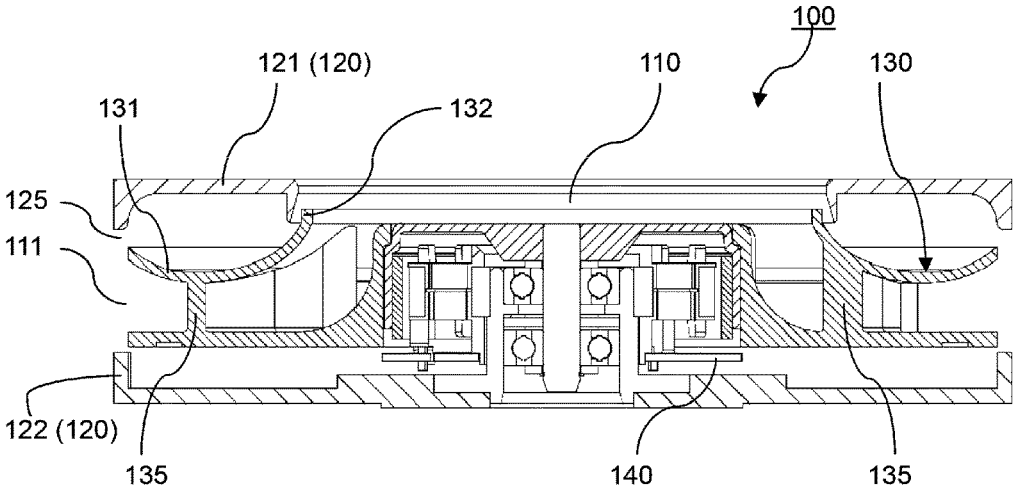
Fig. 5 Prior Art
FIG. 5 is a cross-sectional view illustrating a centrifugal fan of the related art.

As illustrated in FIG. 4, an outer diameter of the upper casing 3 and an outer diameter of the base plate 6 of the lower casing 4 are larger than an outer diameter of the impeller 8. A lower surface 3*b* of an outer circumferential end of the upper casing 3 is formed into an arcuate curved surface in its cross section such that it protrudes toward an upper surface side of the upper casing 3. An outer circumferential end 6*b* of the base plate 6 of the lower casing 4 is also formed into an arcuate curved surface in its cross section such that it protrudes toward a lower surface side of the upper casing 3. For this reason, when air blowing out from the outer circumferential end of the impeller 8 blows out from a space, which becomes the outlet 36 formed between the upper casing 3 and the base plate 6 of the lower casing 4, to the outside of the casing 2, the blowout air blows out in an axial downward direction. Afterwards, the air changes the direction to a slight upward direction, and blows out in a horizontal direction. In this way, since the air blowing out from the outlet 36 blows out in the axial downward direction, air flowing backward from a gap 3*c* between the upper casing 3 and the annular shroud 9 to the inlet 35 side can be suppressed, and a disturbance of the air does not occur. As a result, a noise can be reduced. Cross sections of the lower surface 3*b* and the outer circumferential end 6*b* may not necessarily be in an arcuate shape of a complete circle or an oval circle, and may be a curved surface that protrudes toward the upper surface side of the upper casing 3.

Here, since the outer diameters of the upper casing 3 and the base plate 6 of the lower casing 4 are larger than the outer diameter of the impeller 8, and the outlet 36 is directed in the axial downward direction, a structure in which foreign materials hardly enter the outlet 36 due to the upper casing 3 and the outer circumferential edge 6*b* of the base plate 6 of the lower casing 4 is obtained, and an effect of the measures for safety can also obtained.

As described above, the motor base 5 formed of the metal and the base plate 6 formed of the resin, which constitute the lower casing 4 have been separately described, but the outlet may be configured to be formed of a resin by insert molding of the motor base.

In this way, the invention is not limited to the specific embodiment, and includes various modifications. Those are apparent to those skilled in the art from the description of the claims.

As described with reference to the embodiment, according to the invention, it is possible to provide the centrifugal fan in which an outlet is formed in a lateral surface of the quadrangular casing between the upper casing and the lower casing and which reduces a thickness and inhibits part of air blowing out from the periphery of the impeller from flowing backward to reduce a noise.

What is claimed is:

1. A centrifugal fan comprising:

a casing including an upper casing, a lower casing, and struts disposed between the upper casing and the lower casing; and an impeller that is provided in the casing, the impeller including: an annular shroud having a first outer diameter; a main plate having a second outer diameter that is substantially the same as the first outer diameter; and a plurality of blades that are disposed between the annular shroud and the main plate, wherein the main plate of the impeller has an upper surface to which a lower edge of each of the blades is connected, wherein the upper surface of the main plate includes:

an inner region portion that is located at an inner circumferential area within the main plate and at an upward position in an axial direction of the impeller;

an outer region portion that is located at an outer circumferential area within the main plate and at a downward position in the axial direction of the impeller; and an inclined portion that is located between the inner region portion and the outer region portion and connects the inner region portion and the outer region portion, wherein the lower casing comprises a motor base and a base plate disposed on the motor base, wherein each of the upper casing and the base plate have a larger outer diameter than the impeller, wherein the base plate has a through hole having a diameter larger than the second outer diameter of the main plate so as to receive the main plate of the impeller, wherein a circuit board is disposed above the motor base and an electric component is provided on the circuit board, wherein the electronic component is housed in a space surrounded by the main plate of the impeller and the circuit board, wherein the through hole of the base plate receives the outer region portion of the main plate, and wherein a lower surface of the outer region portion of the main plate is opposed to the motor base.

2. The centrifugal fan according to claim 1, wherein a lower surface of the upper casing at an outer circumferential end thereof is curved downward, and wherein an upper surface of the base plate at an outer circumferential end thereof is curved downward.

3. The centrifugal fan according to claim 1, wherein the motor base is made of a metal, and the base plate is made of a resin.

4. The centrifugal fan according to claim 1, wherein the inner region portion and the outer region portion are flat and parallel to each other.

5. The centrifugal fan according to claim 1, wherein the base plate is provided with lateral portions which extend downward at an outer circumferential end thereof, and wherein inner sides of the lateral portions are contacted with an outer circumference of the motor base.

* * * * *